US011549663B2

(12) United States Patent
Wilcox

(10) Patent No.: US 11,549,663 B2
(45) **Date of Patent: *Jan. 10, 2023**

(54) LIGHT FIXTURE WITH ADJUSTABLE LIGHT DISTRIBUTION ASSEMBLY

(71) Applicant: Hubbell Incorporated, Shelton, CT (US)

(72) Inventor: Shawn Wilcox, Gray Court, SC (US)

(73) Assignee: HLI SOLUTIONS, INC., Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/188,773

(22) Filed: Mar. 1, 2021

(65) Prior Publication Data

US 2021/0180774 A1 Jun. 17, 2021

Related U.S. Application Data

(63) Continuation of application No. 16/193,817, filed on Nov. 16, 2018, now Pat. No. 10,948,167.

(60) Provisional application No. 62/587,870, filed on Nov. 17, 2017.

(51) Int. Cl.

| | |
|---|---|
| ***F21V 14/04*** | (2006.01) |
| ***F21V 29/70*** | (2015.01) |
| ***F21V 17/12*** | (2006.01) |
| ***F21V 21/30*** | (2006.01) |
| ***F21S 8/02*** | (2006.01) |
| ***F21Y 115/10*** | (2016.01) |

(52) U.S. Cl.
CPC ..... *F21V 14/04* (2013.01); *F21S 8/026* (2013.01); *F21V 17/12* (2013.01); *F21V 21/30* (2013.01); *F21V 29/70* (2015.01); *F21Y 2115/10* (2016.08)

(58) Field of Classification Search
CPC .. F21S 8/026–028; F21V 14/04; F21V 17/12; F21V 21/14–30; F21V 29/50–83
See application file for complete search history.

(56) References Cited

U.S. PATENT DOCUMENTS

| | | | | |
|---|---|---|---|---|
| 7,484,866 | B1 * | 2/2009 | Buse | F21S 8/02 362/147 |
| 8,215,805 | B2 | 7/2012 | Cogliano et al. | |
| 8,226,278 | B2 | 7/2012 | Ward | |
| 8,708,522 | B2 | 4/2014 | Wang | |
| 8,770,779 | B2 | 7/2014 | Steadman et al. | |
| 9,488,350 | B2 | 11/2016 | Wilcox | |
| 9,982,855 | B1 | 5/2018 | Tan | |

OTHER PUBLICATIONS

Gotham Incito 2" Adjustable/Lensed Adjustable specification, copyright 2015, Acuity Brands Lighting, Inc. (2 pages).

(Continued)

*Primary Examiner* — Jason M Han
(74) *Attorney, Agent, or Firm* — Michael Best & Friedrich LLP

(57) ABSTRACT

A lighting fixture includes a light engine, a reflector, a housing, and an adjustment assembly for moving the reflector relative to the housing. The light engine includes a light emitter. The reflector is positioned proximate the light emitter and is configured to receive light output from the light emitter. The housing is positioned around at least a portion of the reflector. The adjustment assembly includes a first adjuster and a second adjuster.

14 Claims, 11 Drawing Sheets

(56) References Cited

OTHER PUBLICATIONS

Gotham 2" Incito Adjustable Solid-State Lighting specification, copyright 2012-2017, Acuity Brands Lighting, Inc. (4 pages).
DLSZP [LEDX] Recessed LED Downlight (IC, Non-IC, Remodel) Round Adjustable Dual-Axis specifications, copyright 2014, Lucifer Lighting Company (4 pages).
R2ARM 2" LED Adjustable Recessed Downlight: Remodel Specifications/Features, Contech Lighting.
Installation Instructions for the ConTech Lighting 2" Adjustable Downlight Series: R2A, Contech Lighting.

* cited by examiner

LIGHT FIXTURE WITH ADJUSTABLE LIGHT DISTRIBUTION ASSEMBLY

CROSS-REFERENCE TO RELATED APPLICATIONS

The present application is a continuation of co-pending, prior-filed U.S. patent application Ser. No. 16/193,817, filed Nov. 16, 2018, which claims priority to U.S. Provisional Patent Application No. 62/587,870, filed Nov. 17, 2017. The entire contents of these applications are incorporated by reference herein.

BACKGROUND

The present disclosure relates to a light fixture, and particularly to an adjustment device for a light fixture.

SUMMARY

In one independent aspect, a lighting fixture includes a light engine, a reflector, a housing, and an adjustment assembly for moving the reflector relative to the housing. The light engine includes a light emitter. The reflector is positioned proximate the light emitter and is configured to receive light output from the light emitter. The housing is positioned around at least a portion of the reflector. The adjustment assembly includes a first adjuster and a second adjuster.

In another independent aspect, an adjustment system is provided for a lighting fixture. The lighting fixture includes a light engine, a reflector coupled to the light engine, and a housing positioned around the reflector. The adjustment assembly includes a first adjuster and a second adjuster. The first adjuster includes a first fastening member, and an adjustment nut coupled to the reflector and received within an elongated slot. The first fastening member is received within the adjustment nut. The second adjuster includes an adjustment member and a second fastening member engaging the adjustment member. The adjustment member is movable between a first position and a second position. The adjustment member secures movement of the reflector relative to the housing while the adjustment member is in the first position, and the adjustment member permits movement of the reflector relative to the housing while the adjustment member is in the second position. Loosening the second fastening member permits the adjustment member to be moved between the first position and the second position, and tightening the second fastening member secures the adjustment member in at least one of the first position and the second position.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to adjustment devices for changing a light fixture's orientation and/or position after installation. In some embodiments, the adjustment devices pivot the light fixture about a parallel or transverse axis.

Figure 1:
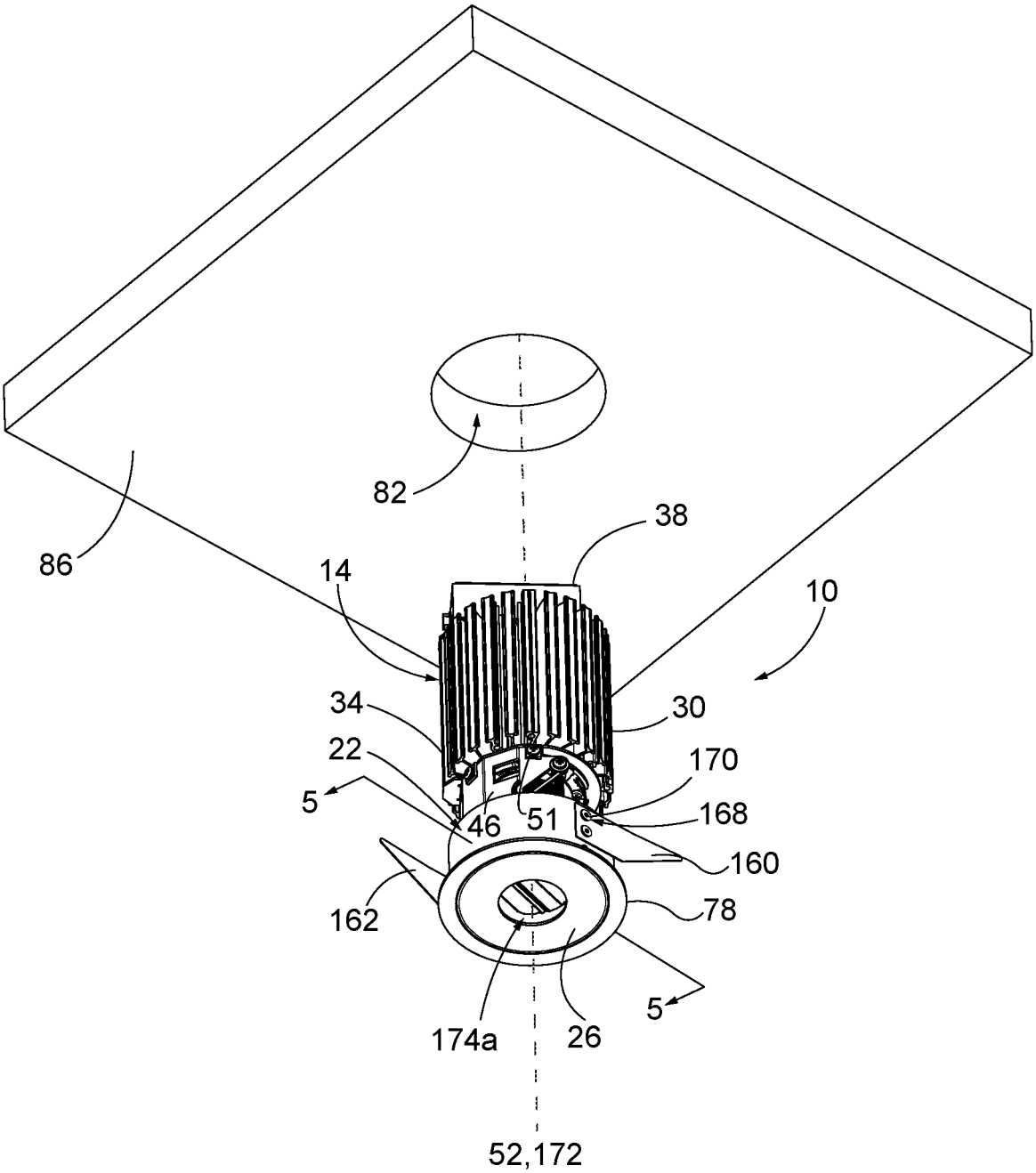
FIG. 1 is a perspective view of a light fixture.
Figure 2:
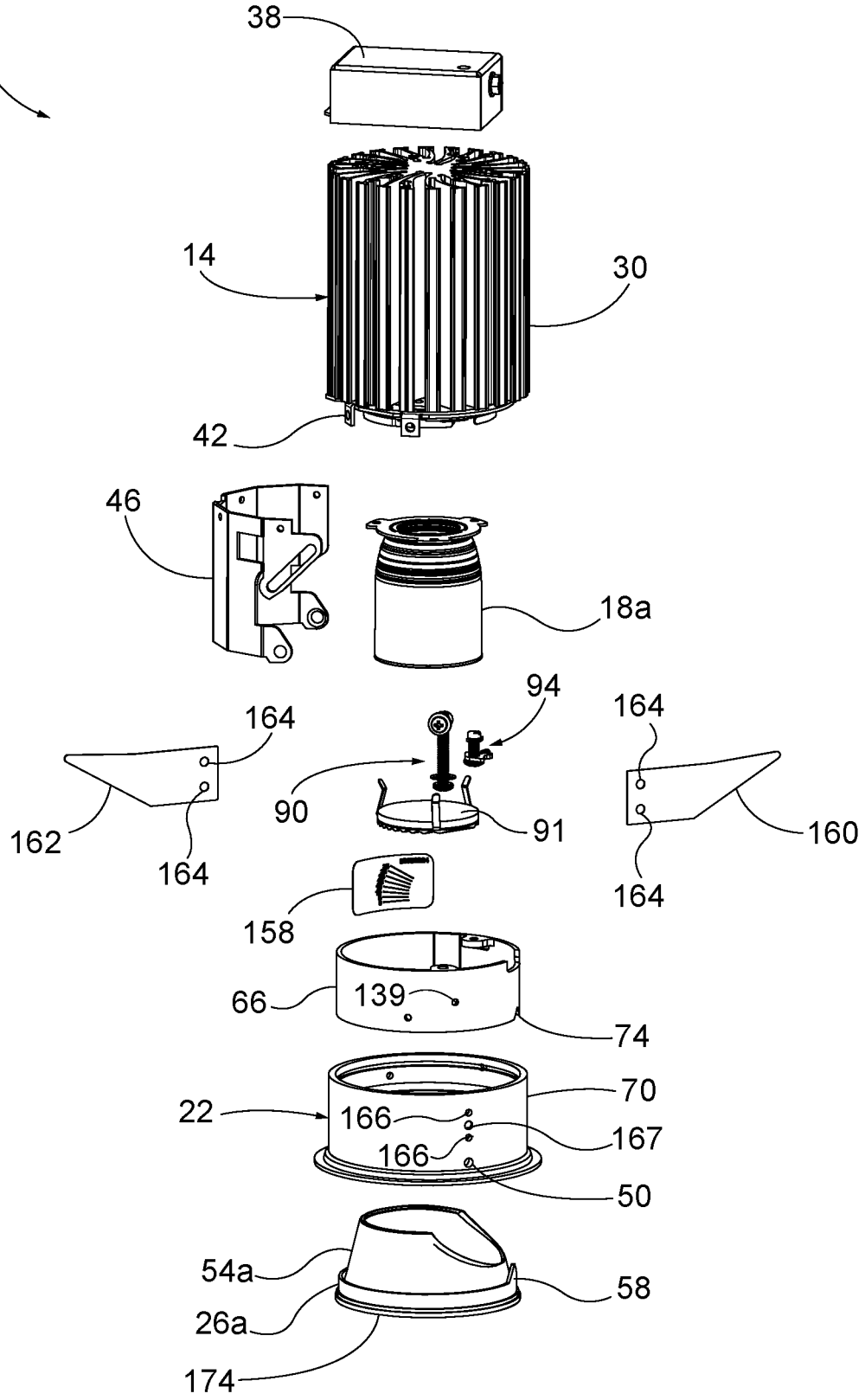
FIG. 2 is an exploded view of the light fixture of FIG. 1.
Figure 4A:
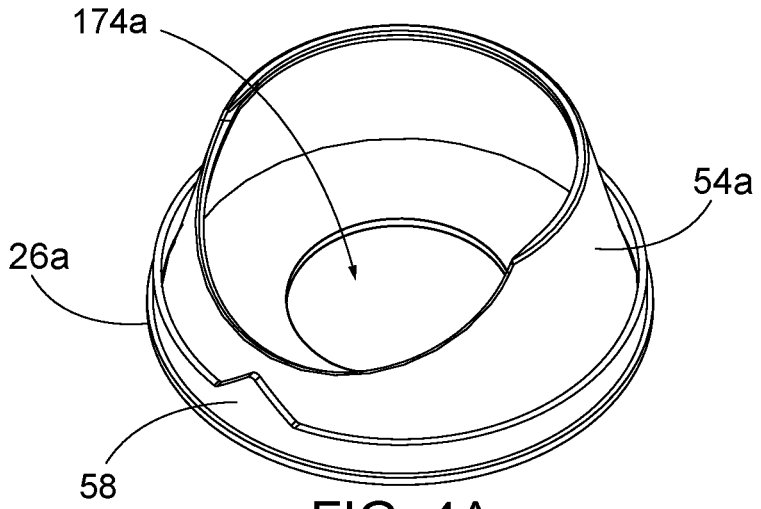
FIG. 4A is a perspective view of a first trim according to one example.
Figure 4B:
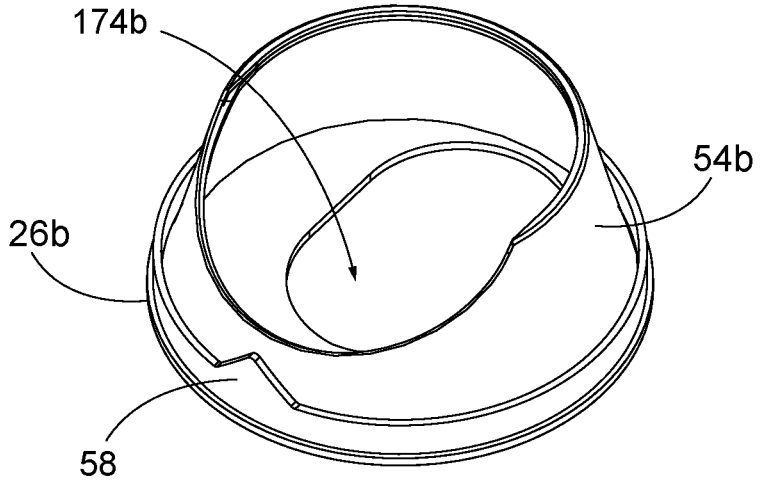
FIG. 4B is a perspective view of a second trim according to another example.
Figure 4C:
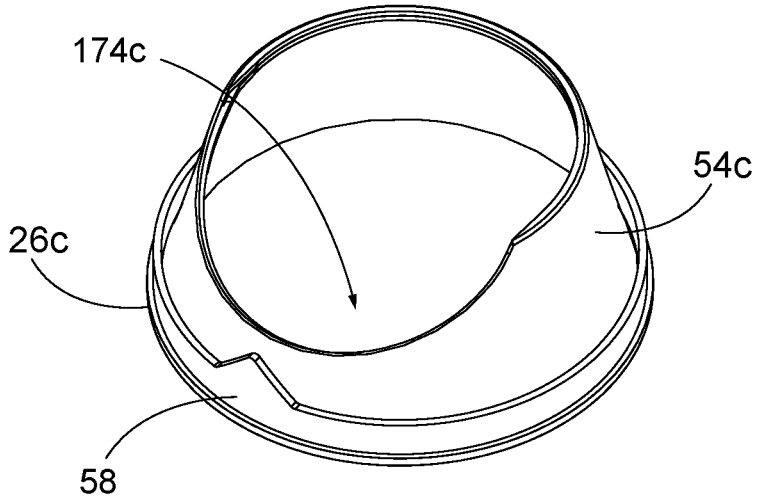
FIG. 4C is a perspective view of a third trim according to yet another example.

As shown in FIGS. 1 and 2, a light fixture 10 includes a light engine 14, a reflector 18 (FIG. 2), a housing 22, and a trim 26. In the illustrated embodiment, the light fixture 10 is cylindrical in shape. The light engine 14 and the reflector 18 may collectively be referred to as a light distribution assembly. The reflector 18 is coupled to the light engine 14 and is positioned in an upper end of the housing 22. The trim 26*a* (FIG. 4A) is a pinhole trim and is removably coupled to an end of the housing 22 proximate an end of the reflector 18 from which light is emitted. In the illustrated embodiment, the trim 26*a* includes an opening 174*a*. The circular opening 174*a* has a diameter that is substantially less than a diameter of the lower end of the trim 26*a*. As shown in FIGS. 4A-4C, the trim 26 may include an opening having a different shape. For example, a slot trim 26*b* (FIG. 4B) includes a slot or elongated opening 174*b*, while a trim 26*c* (FIG. 4C) includes an opening 174*c* that is larger than the opening 174*a* and substantially coextensive with a diameter of the lower end of the trim 26*c*. A user may interchange these trims 26 to adjust the light emitted from the housing 22.

Figure 6:
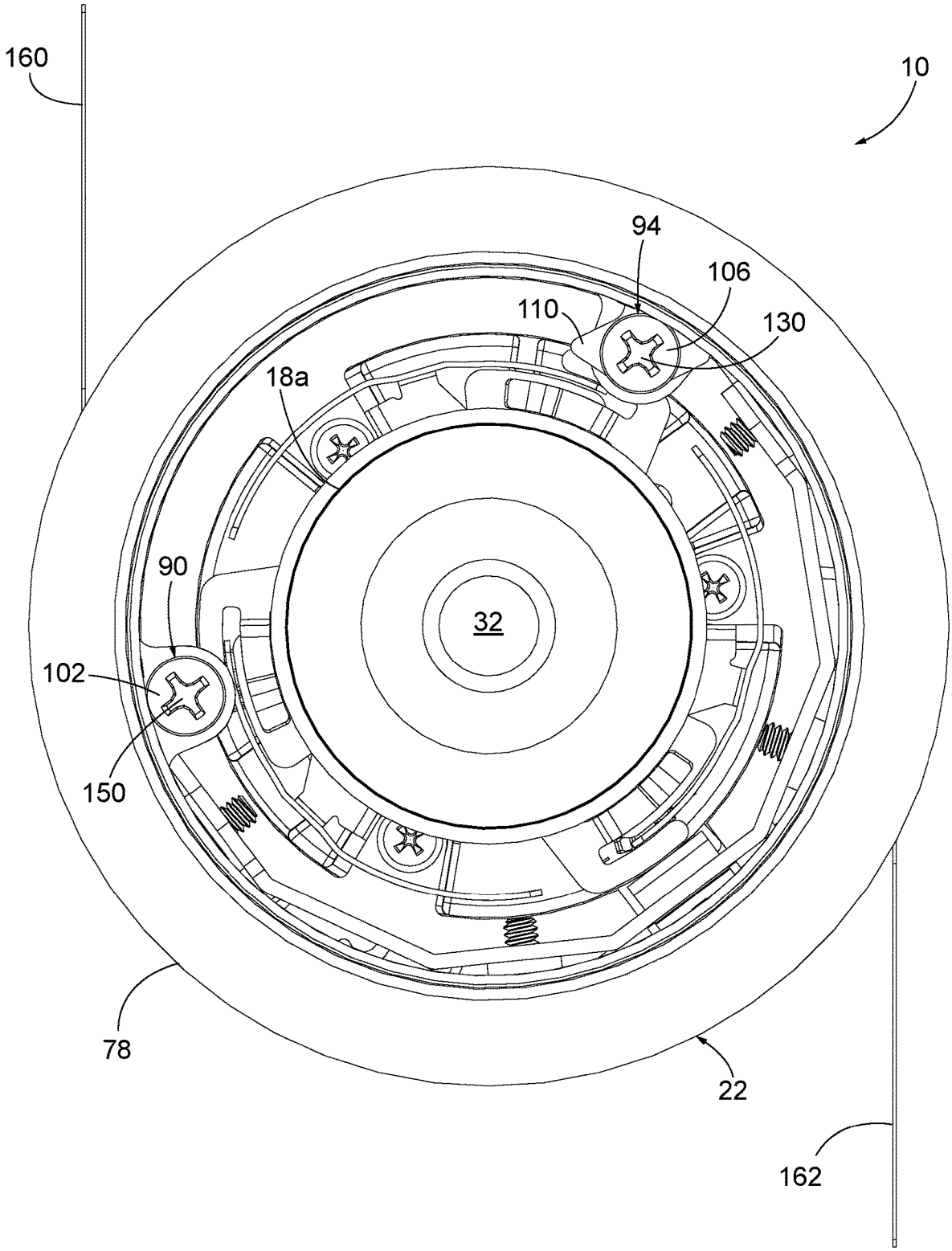
FIG. 6 is a plan view of the light fixture of FIG. 1 with a trim removed.

The light engine 14 includes a heat sink 30 and light emitters 32 (FIG. 6). In the illustrated embodiment, the light emitters 32 are light emitting diodes (LEDs) coupled to an LED board, and the LEDs are coupled to an end of the heat sink 30 and positioned proximate the reflector 18. In the illustrated embodiment, a junction box 38 is coupled to an end of the heat sink 30 opposite the end coupled to the LEDs 32. The LEDs 32 are in electrical communication with the junction box 38 via one or more wires (not shown). The heat sink 30 has a solid center portion, and the wires are positioned on an outer surface of the heat sink 30 and provide electrical communication between the LEDs 32 and the junction box 38. A wire cover 34 is coupled to the outer surface of the heat sink 30 and encloses the wires.

In the illustrated embodiment, a light engine mount 42 (FIG. 2) is positioned adjacent an end of the heat sink 30 proximate the LEDs 32. The light engine mount 42 is coupled to a bracket 46, for example, by fasteners 51 or screws. In the illustrated embodiment, the bracket 46 is disposed partially around the reflector 18. In other embodiments, the bracket 46 may be disposed completely around the reflector 18, and/or may have a different shape.

Figure 3A:
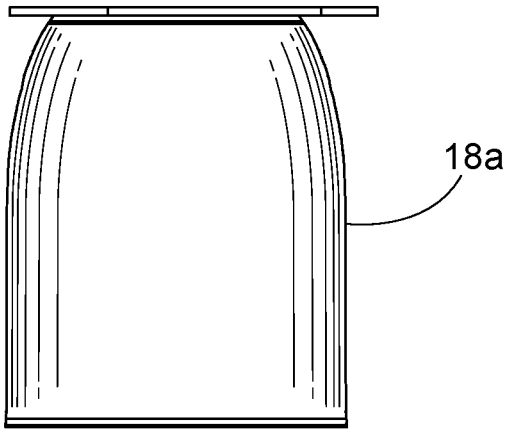
FIG. 3A is a side view of a reflector according to one example.
Figure 3B:
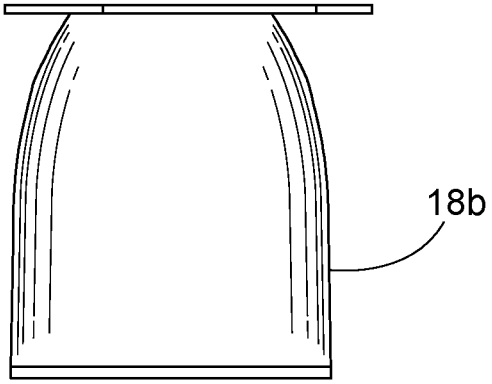
FIG. 3B is a side view of a reflector according to another example.
Figure 3C:
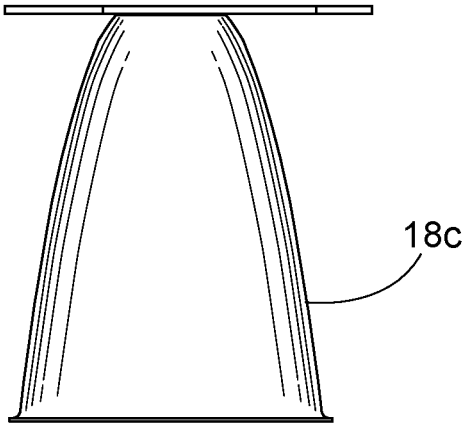
FIG. 3C is a side view of a reflector according to yet another example.
Figure 7:
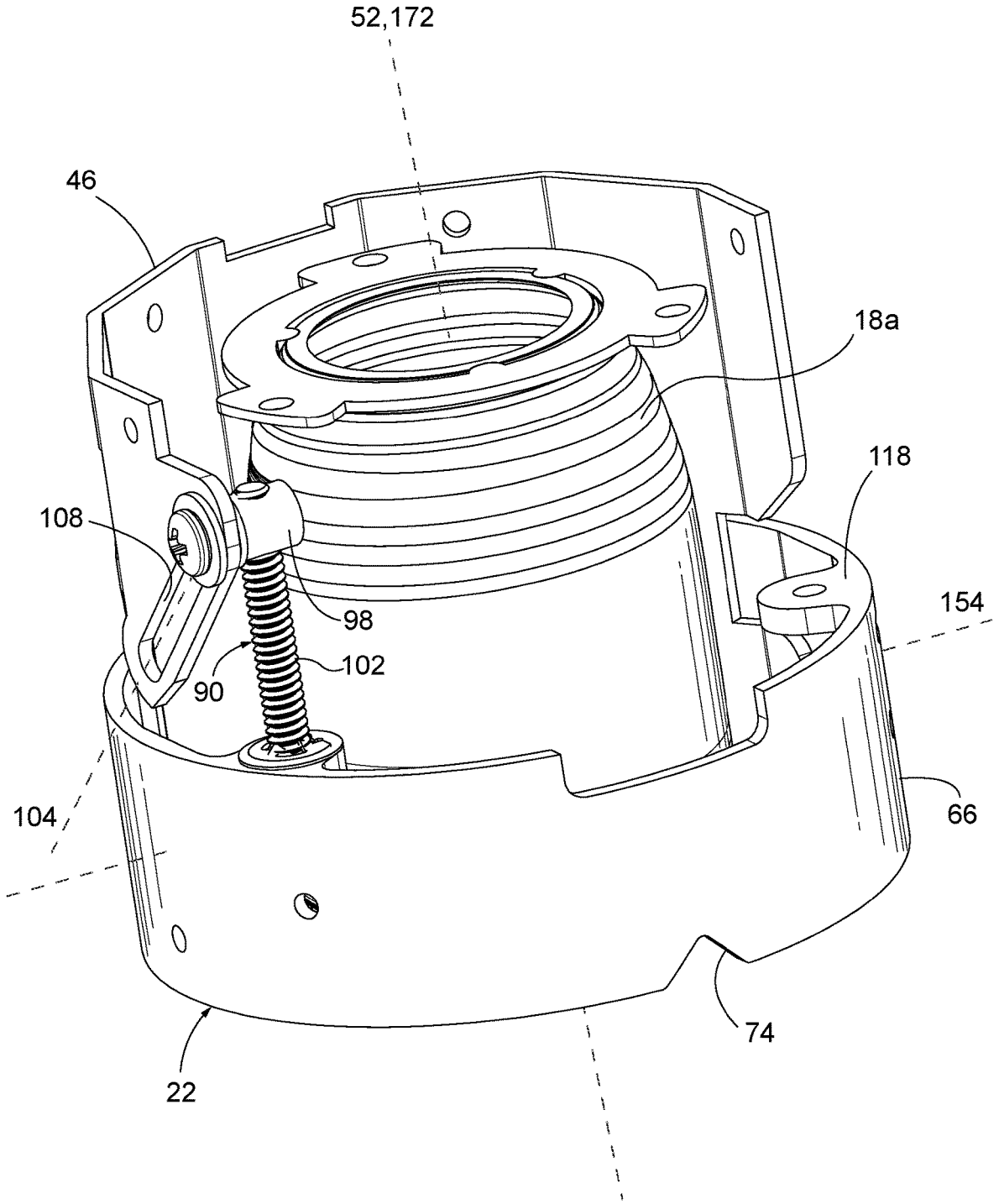
FIG. 7 is perspective view of a portion of the light fixture of FIG. 1, including a first adjuster.

The reflector 18 is coupled to the heat sink 30 and extends into the housing 22. As shown in FIGS. 2 and 7, the reflector 18*a* is tapered, having a smaller width proximate the heat sink 30 (FIG. 2) than a width proximate the housing 22. As shown in FIGS. 3A-3C, in other embodiments, the reflector 18 may have a different shape. For example, a second reflector 18*b* (FIG. 3B) has an upper diameter (i.e., the diameter proximate the heat sink 30) smaller than an upper diameter of the reflector 18*a* (FIG. 3A) and has a longer tapered section than the reflector 18*a*. Also, a third reflector 18*c* (FIG. 3C) may have a substantially parabolic profile, with a longer tapered section than the reflectors 18*a*, 18*b*. The fixture 10 may include any one of these reflectors 18*a*-18*c* to create different light beam angles and distribution. The LEDs 32 (FIG. 6) are positioned within the reflector 18 and aligned along a reflector axis 52 (FIG. 1).

Figure 5:
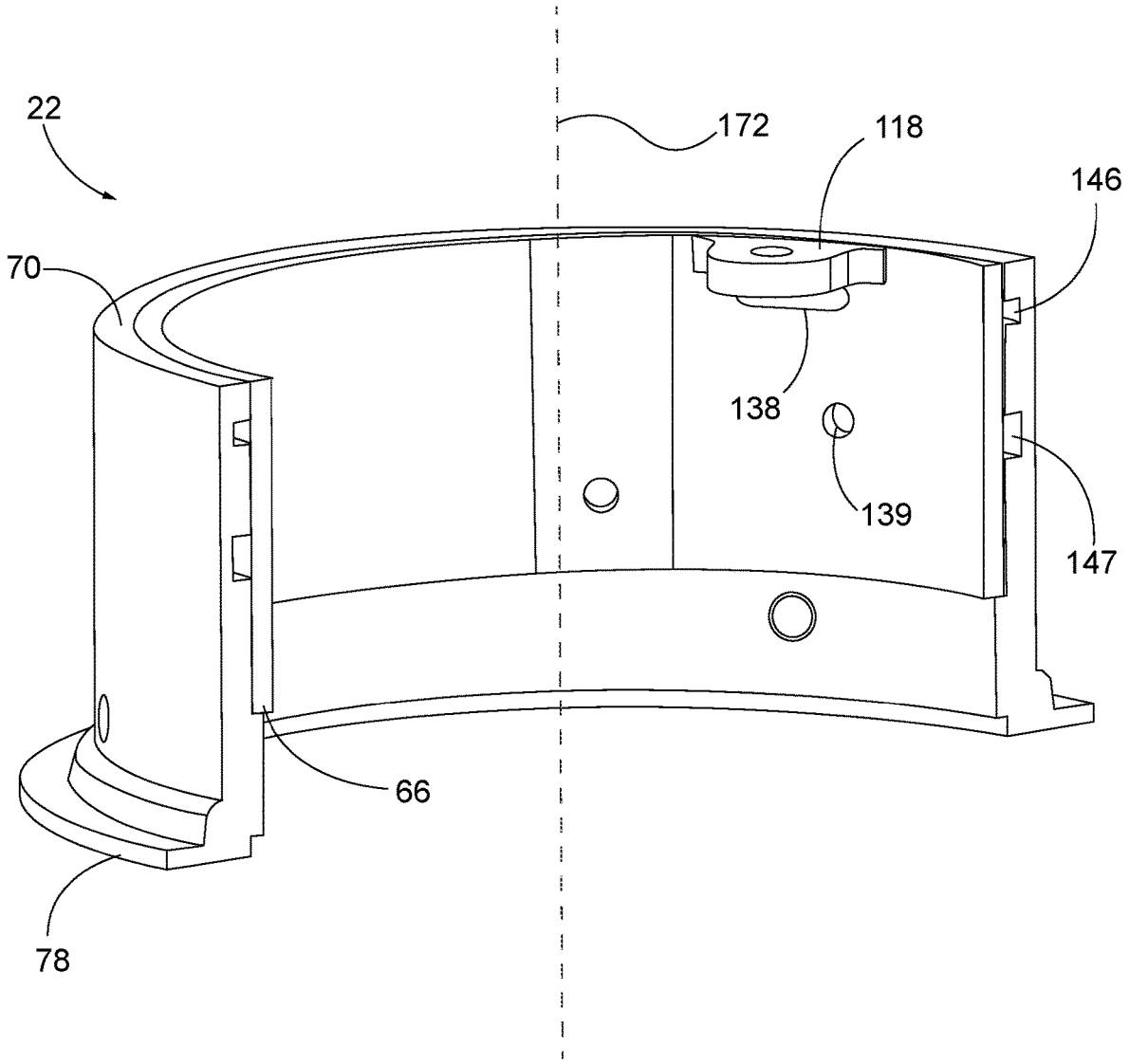
FIG. 5 is a cross-sectional view of a housing of the light fixture of FIG. 1, viewed along section 5-5.

As shown in FIG. 5, the housing 22 includes an inner portion or ring 66 and an outer portion or ring 70. The inner ring 66 is adjacent to and extends at least partially along an inner perimeter or surface of the outer ring 70. In the illustrated embodiment, a feature 74 (FIG. 2) on the inner ring 66 is triangular in shape. The outer ring 70 includes a flange or lip 78 that extends radially away from an outer surface of the outer ring 70. In the illustrated embodiment, a groove 146 extends along a perimeter of the inner surface of the outer ring 70. The inner ring 66 has an inner ring slot 138 which is aligned with the groove 146. The inner ring 66 also has a projection or an inner ring tab 118 positioned adjacent the inner ring slot 138.

A setscrew groove 147 extends along the perimeter of the inner surface of the outer ring 70 and is axially spaced apart from the groove 146. In the illustrated embodiment, the setscrew groove 147 is disposed closer to the lip 78 than the groove 146. A first setscrew aperture 139 extends through the inner ring 66 and is oriented substantially in the same plane as the setscrew groove 147.

Referring again to FIGS. 1 and 2, a first spring wing 160 and a second spring wing 162 are coupled to the housing 22. The first spring wing 160 and the second spring wing 162 each include at least one aperture 164 that aligns with an associated opening 166 extending through the outer ring 70. Mounting setscrews 168 are inserted through the apertures 164 and the associated openings 166 to secure each spring wing 160, 162 to the housing 22. In the illustrated embodiment, a setscrew head 170 is proximate the outer ring 70, although in other embodiments, the setscrew head may be proximate the inner ring 66.

A second setscrew aperture 167 is disposed between the associated openings 166 of each respective spring wings 160, 162 and extends through the outer ring 70 into the setscrew groove 147. The inner ring 66 is rotated to align the first setscrew aperture 139 with the second setscrew aperture 167. In the illustrated embodiment, a setscrew 169 (FIG. 8) can be inserted into the apertures 139, 167 from an outer surface of the housing 22 (i.e., through the second setscrew aperture 167 and then through the first setscrew aperture 139), and the setscrew 169 is inserted completely through the second setscrew aperture 167 such that an outer end of the setscrew 169 rests within the groove 147, thereby retaining the inner ring 66 within the outer ring 70. Inserting the setscrew 169 from the outer surface of the housing facilitates easier installation than if the setscrew 169 was inserted initially through the first setscrew aperture 139 because there is additional space to maneuver the setscrew 169.

As shown in FIG. 2, the outer surface of the outer ring 70, proximate the lip 78, includes magnets 50. In the illustrated embodiment, the outer ring 70 includes three magnets 50, although in other embodiments, the outer ring 70 may include fewer or more magnets 50. The magnets 50 allow the trim 26 to removably couple to the housing 22. The trim 26 includes a profile portion 54 and a positioning tab 58 that extends from the profile portion 54 and is substantially the same shape as the feature 74 of the inner ring 66. In some embodiments, the profile portion 54 has a substantially frustoconical shape and includes a cutout for permitting movement of the reflector 18. The positioning tab 58 is configured to fit within the feature 74 when the trim 26 is coupled to the housing 22 so that the trim 26 is aligned with the housing 22.

In some embodiments, the light fixture 10 is configured to be inserted within a two-inch ceiling aperture 82 (FIG. 1), although in other embodiments, the ceiling aperture may be larger or smaller than two inches. The light fixture 10 is positioned such that the light engine 14 is proximate the ceiling aperture 82. The light fixture 10 is then inserted through the ceiling aperture 82 until the lip 78 abuts the ceiling surface 86. The first spring wing 160 and a second spring wing 162 retain the light fixture 10 in the ceiling 86. One spring wing (e.g., the first spring wing 160) covers the setscrew 169 and the associated apertures 139, 167 in order to limit dust or other debris from entering the housing 22 (e.g., through the apertures 139, 167) during installation and operation of the light fixture 10. The trim 26 and the reflector 18 may be replaced while the light fixture 10 is inserted within the ceiling aperture 82. A user can change the light beam angle and other light beam characteristics by interchanging the reflectors 18*a*-18*c* (FIGS. 3A-3C) and the trims 26*a*-26*c* (FIGS. 4A-4C). A lens media clip 91 may be positioned adjacent an internal surface of the reflector 18*a* and further modify the beam characteristics.

After the light emitter 10 is positioned within the ceiling, a first adjustment device or adjuster 90 and a second adjustment device or adjuster 94 may be actuated to reposition the direction of light emitted from the LEDs 32. As shown in FIG. 6, the trim 26 (FIG. 2) may be decoupled from the housing 22 to expose the first adjuster 90 and the second adjuster 94. In an initial position of the light fixture 10 (FIG. 1), the reflector axis 52 extends through a center of the trim 26.

As shown in FIG. 7, the first adjuster 90 includes an adjustment nut 98 and a first fastening member (i.e., a screw) 102. The adjustment nut 98 engages a slot 108 on the bracket 46. In the illustrated embodiment, the slot 108 has an elongated shape and extends along a slot axis 104. The slot axis 104 forms an oblique angle with respect to an axis parallel to the reflector axis 52. The first fastening member 102 is coupled to the housing 22 (e.g., to the inner ring 66 and is threadably engaged with the adjustment nut 98.

Figure 8:
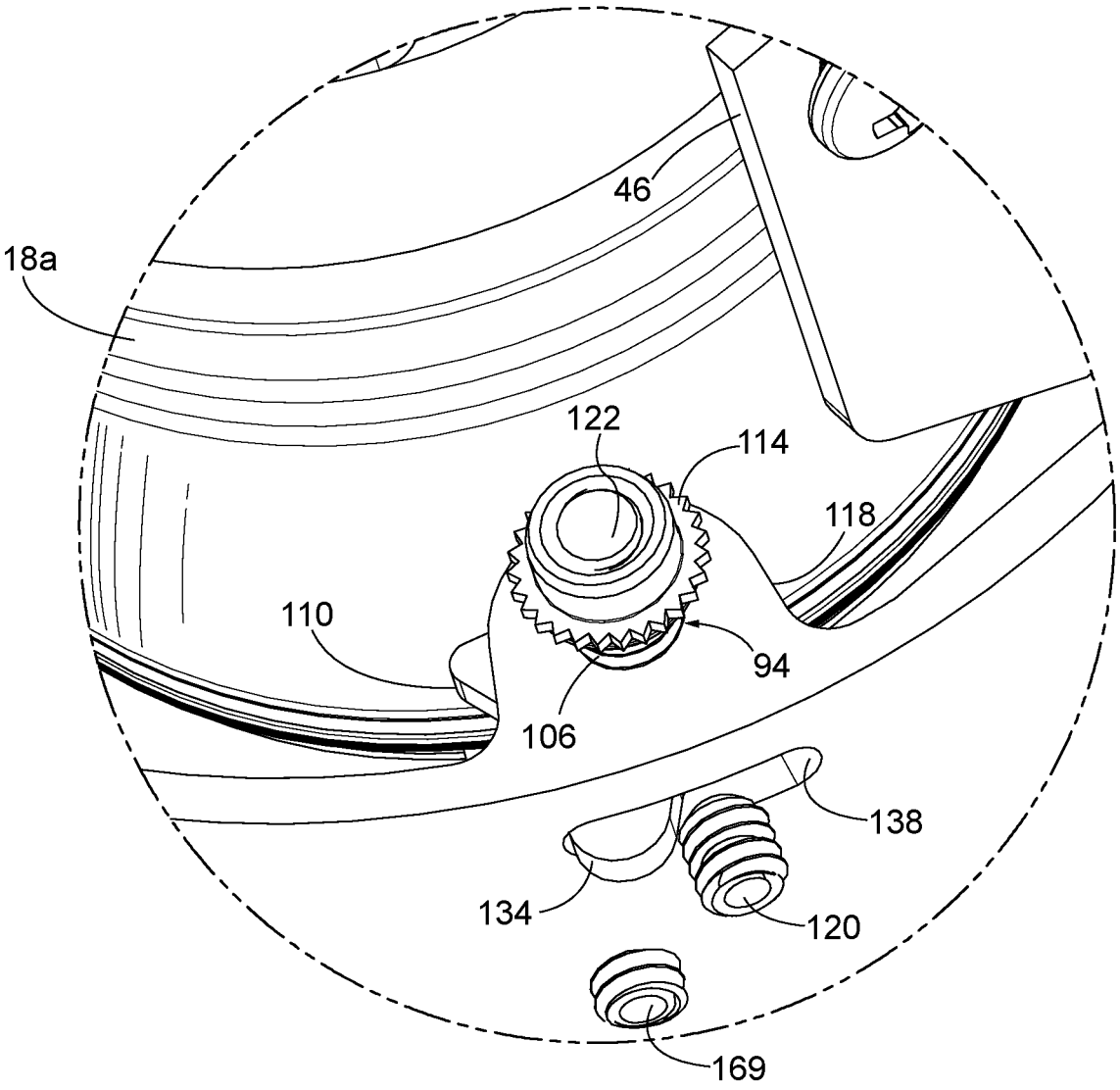
FIG. 8 is a perspective view of a second adjuster.
Figure 9:
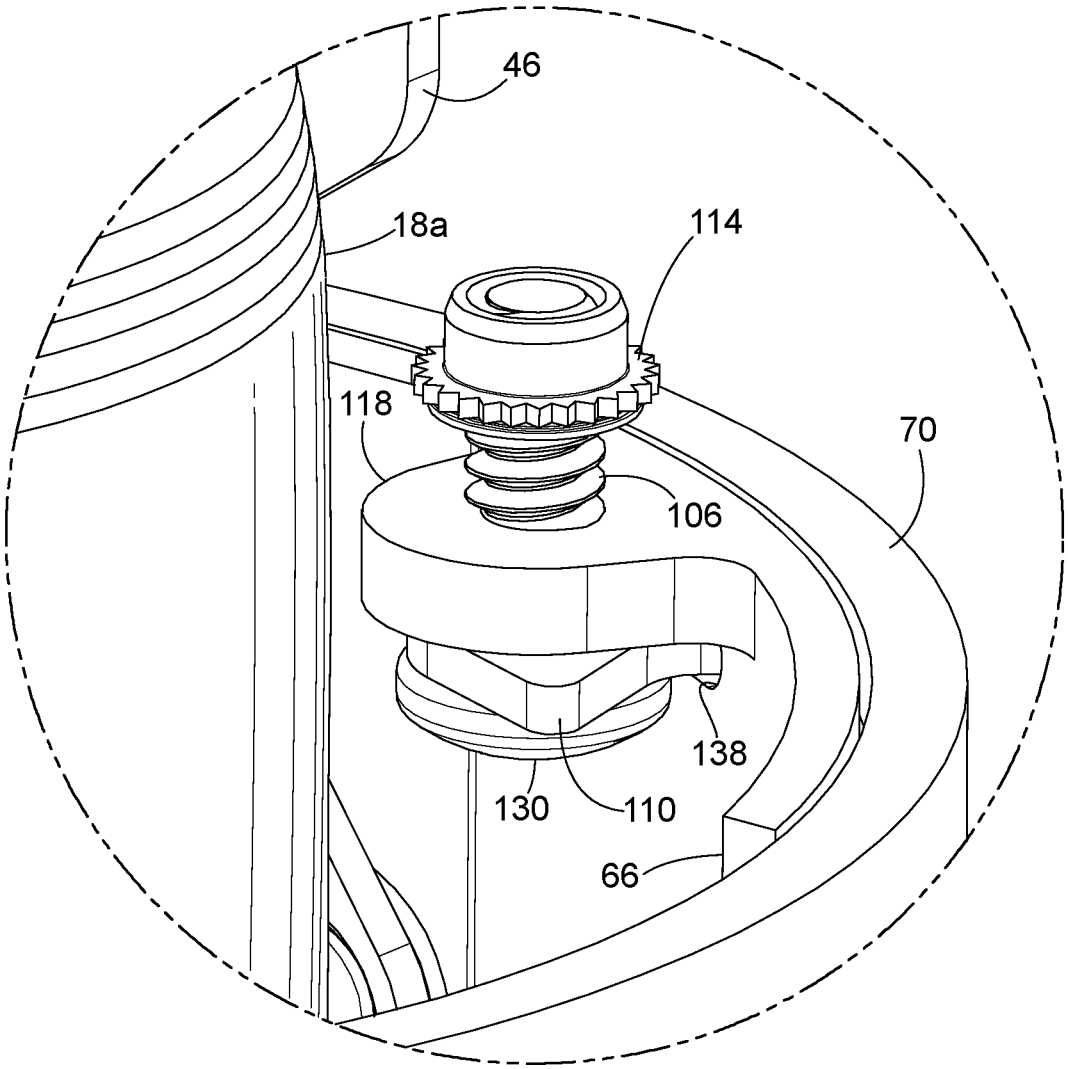
FIG. 9 is another perspective view of the second adjuster of FIG. 8.

As shown in FIGS. 8 and 9, the second adjuster 94 includes a second fastening member 106, an adjustment tab 110, and a securing member (i.e., a nut) 114. The second fastening member 106 is inserted through the adjustment tab 110, the inner ring tab 118, and the securing member 114. The securing member 114 is disposed on an end 122 of the second fastening member 106 (e.g., the end proximate the light engine 14—FIG. 1). The adjustment tab 110 is disposed between the inner ring tab 118 and a screw head 130 (FIG. 6). The adjustment tab 110 includes a finger 134 that is positioned in the inner ring slot 138 on the inner ring 66 and extends into the groove 146 of the outer ring 70 (FIG. 5). A set-stop screw 120 (FIG. 8) is positioned proximate the inner ring slot 138. In the illustrated embodiment, the set-stop screw 120 extends partially into the inner ring slot 138.

To adjust the lighting fixture 10 in a first direction, about a transverse housing axis 154 (FIG. 7), a tool (i.e., a screwdriver—not shown) is inserted into a head 150 (FIG. 6) of the first fastening member 102 and is rotated in a first direction. The first fastening member 102 is coupled to the inner ring 66 which does not move relative to the reflector axis 52 (FIG. 7). The first fastening member 102 cannot extend further into the adjustment nut 98 while the lighting fixture 10 is in the initial position when the reflector axis 52 is aligned with a parallel housing axis 172 (FIG. 1). The parallel housing axis 172 extends through a center of and is parallel to the inner ring 66 and the outer ring 70 (FIG. 5). As the adjustment nut 98 moves within the slot 108, the first fastening member 102 is threaded through the adjustment nut 98.

Figure 10:
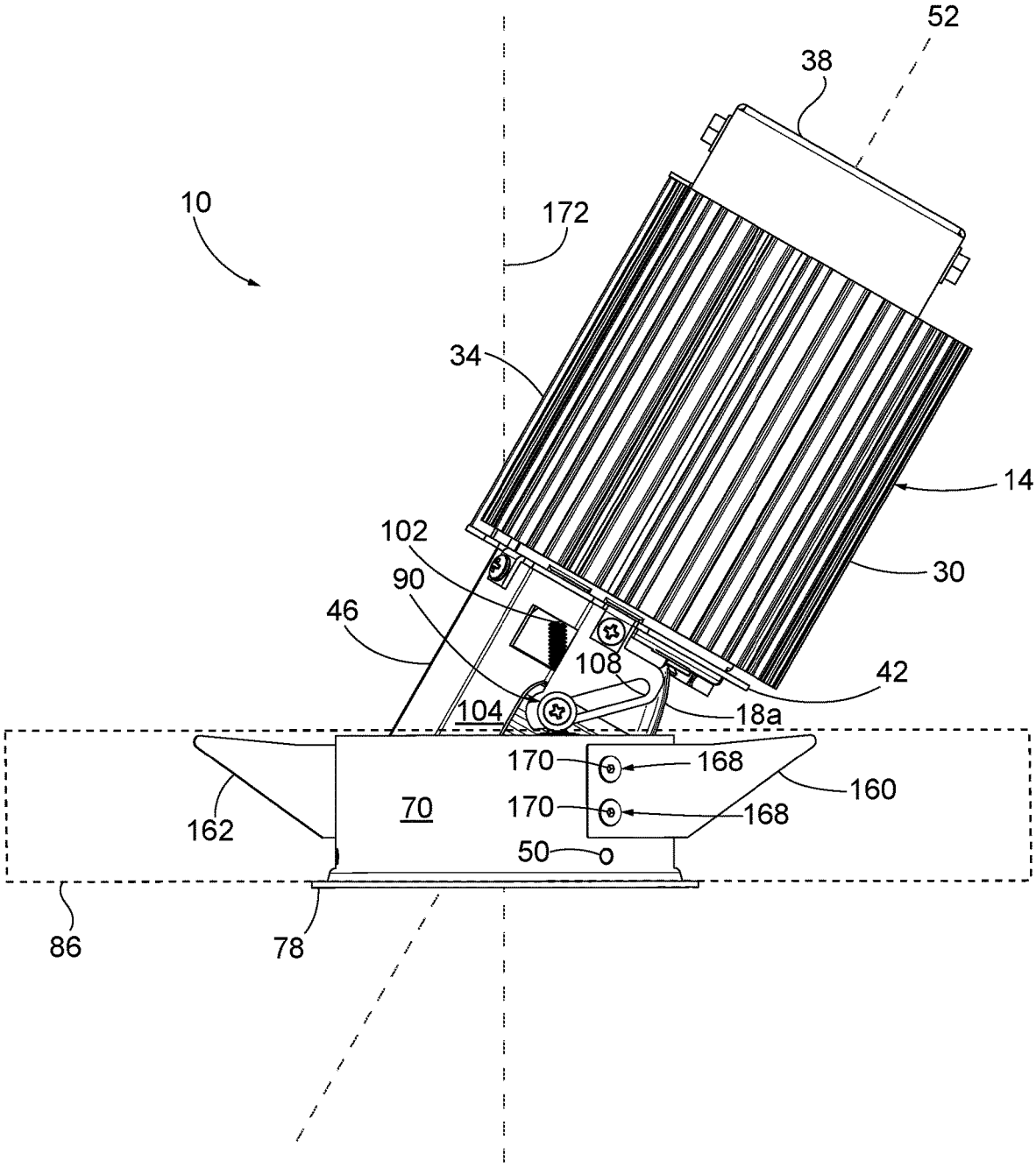
FIG. 10 is a side view of the light fixture of FIG. 1 in first position.

As shown in FIG. 10, the slot 108 is formed at an oblique angle relative to the reflector 18, and movement of the adjustment nut 98 within the slot 108 causes the bracket 46 to pivot about the transverse housing axis 154 (FIG. 7) which extends through the inner ring 66 and the outer ring 70 and is offset from a center of the housing 22. Movement of the adjustment nut 98 within the slot 108 allows the adjustment nut 98 to remain in a position to receive the first fastening member 102. The light engine 14 and the reflector 18 are coupled to the bracket 46 (FIG. 2) and also rotate. In the illustrated embodiment, as the adjustment nut 98 slides within the slot 108 towards the housing 22, the light engine 14, the bracket 46, and the reflector 18 pivot away from vertical (i.e., the reflector axis 52 pivots away from the housing axis 172 increasing an angle between the reflector axis 52 and the housing axis 172). Rotating the tool in a second direction slides the adjustment nut 98 within the slot 108 away from the housing 22 allowing the light engine 14, the bracket 46, and the reflector 18 pivot towards vertical (i.e., the reflector axis 52 pivots toward the housing axis 172 decreasing an angle between the reflector axis 52 and the housing axis 172). In the illustrated embodiment, the light engine 14, the bracket 46, and the reflector 18 may pivot to an angle of 35 degrees relative to the transverse housing axis 154; in other embodiments, the light engine 14, the bracket 46, and the reflector 18 may pivot through a greater or lesser angle. A rotation indicator 158 (FIG. 2) is provided on the inner ring 66 to indicate the angle of the light engine 14, the bracket 46, and the reflector 18 relative to a vertical axis (e.g., the housing axis 172). The first fastening member 102 is self-locking and will not move without user actuation through the tool.

As the light engine 14 and reflector 18 pivot, the direction of light emitted from the LEDs 32 changes. By adjusting the first fastening member 102, a user can adjust the angle of light emitted by the LEDs 32 without removing the light fixture 10 from the ceiling aperture 82 (FIG. 1).

Initially, the second fastening member 106 causes the adjustment tab 110 to press against the inner ring tab 118 (FIG. 8). To adjust the lighting fixture 10 in a second direction, the tool is inserted into the screw head 130 of the second fastening member 106 (FIG. 6) and is rotated in a first direction. Rotation of the tool in the first direction causes the second fastening member 106 to move proximate the lip 78 and the securing member 114 to move proximate the inner ring tab 118. Rotation of the tool in the first direction also causes the adjustment tab 110 to move away from the inner ring tab 118 so that the adjustment tab 110 no longer presses against the inner ring tab 118.

Referring again to FIGS. 8 and 9, the securing member 114 prevents the second fastening member 106 from being removed from either the adjustment tab 110 or the inner ring tab 118. As the second fastening member 106 moves towards the lip 78, the securing member 114 will abut a surface of the inner ring tab 118, thereby preventing the second fastening member 106 from moving closer to the lip 78 and out of the adjustment tab 110 or the inner ring tab 118.

Once the adjustment tab 110 separates from the inner ring tab 118, a user may rotate the inner ring 66 relative to the outer ring 70 about the parallel housing axis 172 greater than 360 degrees. In the illustrated embodiment, the user may rotate the inner ring 66 up to 370 degrees. The setscrew 169 moves within the setscrew groove 147, and the inner ring 66 may rotate with respect to the outer ring 70 while the setscrew 169 moves along the groove 147. Rotation of the inner ring 66 causes the light engine 14 and the reflector 18 to also rotate since they are coupled together. As the inner ring 66 reaches 360 degrees of rotation, the finger 134 of the adjustment tab 110 contacts the set-stop screw 120. The adjustment tab 110 may pivot as it contacts the set-stop screw 120. This allows the inner ring 66 to rotate further than 360 degrees. The inner ring slot 138 provides the adjustment tab 110 with a limited range of motion to prevent the inner ring 66 from tangling the wires by rotating too far. As the inner ring 66 rotates in the opposite direction, the finger 134 of the adjustment tab 110 pivots and returns to its initial position. Once an adjustment about the parallel housing axis 172 is made, the user tightens the second fastening member 106 by rotating the tool in a second direction, opposite the first direction. The second fastening member 106 pushes the adjustment tab 110 towards the inner ring tab 118 and wedges the adjustment tab 110 in the groove 146 (FIG. 5) to lock the inner ring 66 in place. The second fastening member 106 may be tightened at any position so that the inner ring 66 may be locked at any rotational position.

Figure 11:
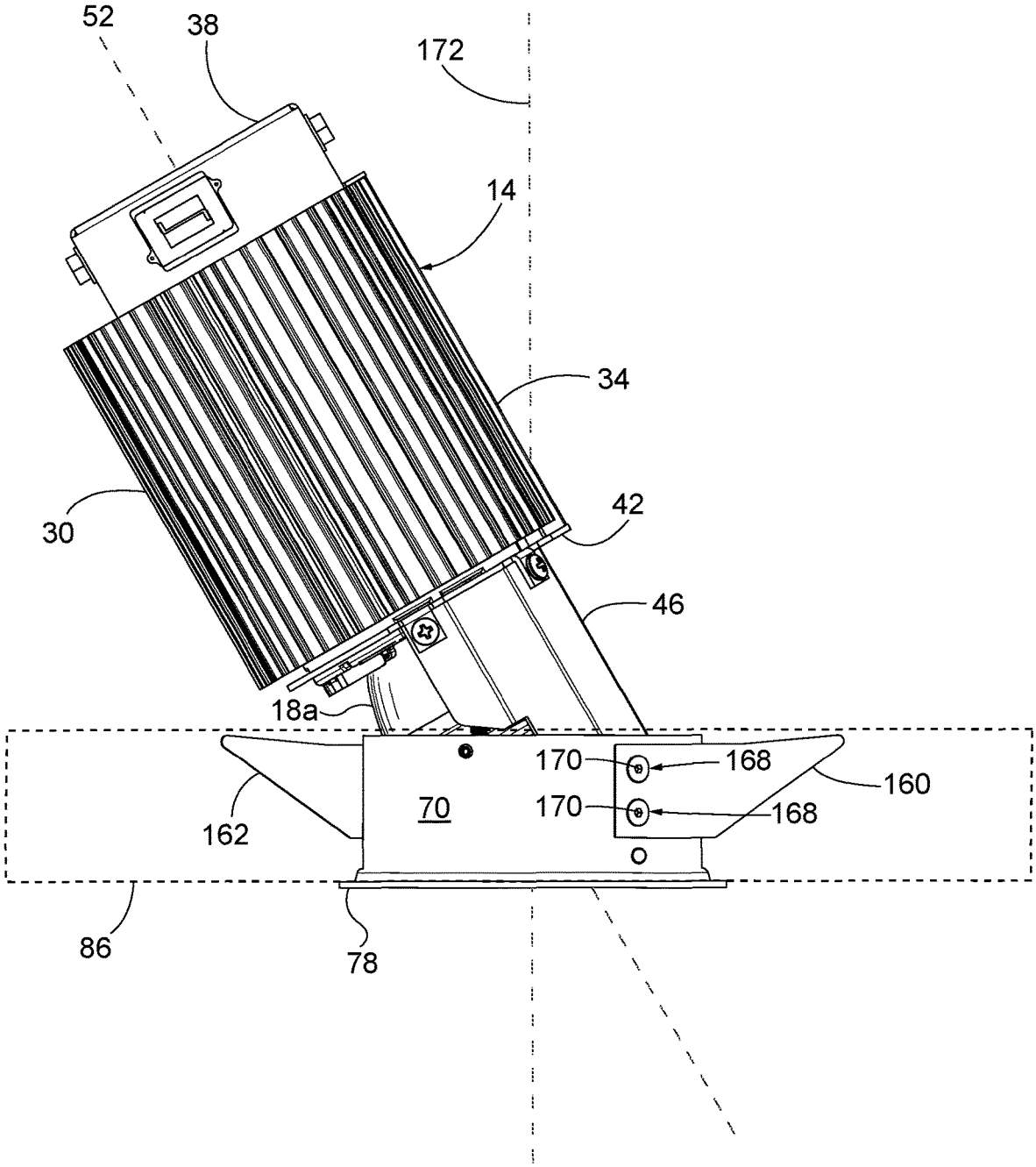
FIG. 11 is a side view of the light fixture of FIG. 1 in a second position.

As the inner ring 66 rotates, the direction of emitted light from the LEDs 32 changes. As shown in FIG. 11, rotating the inner ring 66 after light engine 14 and reflector 18 have been adjusted about the transverse housing axis 154 changes the direction that the light is directed about the parallel housing axis 172. By adjusting the second fastening member 106, a user can adjust the angle of light emitted by the LEDs 32 without removing the light fixture 10 from the ceiling aperture 82 (FIGS. 8 and 9).

Although aspects have been described in detail with reference to certain preferred embodiments, variations and modifications exist within the scope of one or more independent aspects as described.

What is claimed is:

1. A lighting fixture comprising:

a light emitter;

a reflector positioned proximate the light emitter and configured to direct light output generated by the light emitter;

a housing positioned around at least a portion of the reflector; and an adjuster for moving the reflector relative to the housing, the adjuster including a threaded fastener and an adjustment nut, the threaded fastener coupled to the housing and threadably coupled to the adjustment nut, the adjustment nut received within an elongated slot of a bracket, the bracket coupled to the reflector so that a slot axis extending along the elongated slot is positioned obliquely with respect to an axis parallel to a reflector axis, rotation of the threaded fastener causing movement of the adjustment nut within the slot and causing the reflector to pivot about a transverse housing axis orthogonal to the parallel housing axis.

2. The lighting fixture of claim 1, further comprising a heat sink having a solid center, the heat sink operable to receive heat generated by the light emitter.

3. The lighting fixture of claim 1, wherein the housing further includes an inner ring having an inner ring slot and an outer ring having a groove, the inner ring slot aligned with the groove.

4. The lighting fixture of claim 1, wherein the adjustment nut is stationary with respect to the threaded fastener when the threaded fastener is stationary.

5. The lighting fixture of claim 1, wherein the adjuster is a first adjuster, and further comprising a second adjuster including a second fastener, an adjustment tab, and a securing member, the second adjuster coupled to a projection on an inner surface of the housing, tightening the second fastener securing the reflector against movement.

6. The lighting fixture of claim 5, wherein loosening the second fastener allows an inner ring of the housing to rotate while an outer ring of the housing is stationary.

7. The lighting fixture of claim 6, further comprising a groove disposed between the inner ring and the outer ring, a setscrew positioned within the groove to couple the inner ring to the outer ring and allow for free rotation of the inner ring with respect to the other ring.

8. The lighting fixture of claim 1, wherein the reflector is an upper reflector, the light fixture further comprising a lower reflector, the lower reflector removably coupled to the housing by magnets.

9. The lighting fixture of claim 8, wherein removing the lower reflector exposes the first adjuster and the second adjuster.

10. A lighting fixture comprising:

a light emitter;

a reflector positioned proximate the light emitter and configured to direct light output generated by the light emitter;

a housing positioned around at least a portion of the reflector; and an adjuster for moving the reflector relative to the housing, the adjuster including a fastener, an adjustment tab, and a securing member, the adjuster coupled to a projection on an inner surface of the housing, tightening the fastener securing the reflector against movement, the adjuster further including a finger, the finger configured to be positioned in a groove of the housing to secure the reflector against movement relative to the housing while the adjuster is in a first position.

11. The lighting fixture of claim 10, wherein the housing includes an outer portion and an inner portion that is rotatable relative to the outer portion.

12. The lighting fixture of claim 10, wherein the finger is configured to pivot within the groove as an inner portion of the housing rotates relative to an outer portion of the housing, wherein the pivoting of the finger allows the inner portion to rotate greater than one revolution.

13. The lighting fixture of claim 10, wherein the second adjuster is configured to bias the finger against a surface of the groove while the adjustment member is in the first position.

14. The lighting fixture of claim 10, wherein the fastener is coupled to a nut, the nut configured to abut the projection.

* * * * *